US011458345B1

(12) United States Patent
Belcher

(10) Patent No.: US 11,458,345 B1
(45) Date of Patent: Oct. 4, 2022

(54) GYMPERFORMANCE EXERCISE MACHINE

(71) Applicant: Sandra Annette Belcher, Oakland, CA (US)

(72) Inventor: Sandra Annette Belcher, Oakland, CA (US)

( * ) Notice: Subject to any disclaimer, the term of this patent is extended or adjusted under 35 U.S.C. 154(b) by 0 days.

(21) Appl. No.: 16/172,775

(22) Filed: Oct. 27, 2018

(51) Int. Cl.
*A63B 21/008* (2006.01)

(52) U.S. Cl.
CPC ..... *A63B 21/0085* (2013.01)

(58) Field of Classification Search
CPC ..... A63B 21/008; A63B 21/0085; A63B 21/0088; A63B 21/0087; A63B 21/4011; A63B 21/4015; A63B 21/4023; A63B 21/4033; A63B 23/03516; A63B 23/03525; A63B 23/0355; A63B 23/03533; A63B 23/03541; A61H 1/00; A61H 1/001; A61H 1/005; A61H 1/006; A61H 1/008; A61H 1/02; A61H 1/0214; A61H 1/0237; A61H 1/0266; A61H 2001/0211; A61H 2001/027
See application file for complete search history.

(56) References Cited

U.S. PATENT DOCUMENTS 4,645,200 A * 2/1987 Hix ..... A63B 22/0056 482/131
4,940,233 A * 7/1990 Bull ..... A63B 21/4047 482/70
4,989,858 A * 2/1991 Young ..... A63B 21/4047 482/53
5,104,363 A * 4/1992 Shi ..... A63B 22/0076 482/73
7,811,216 B2 * 10/2010 Babiarz ..... A63B 21/00069 482/142
8,784,277 B2 * 7/2014 Prats ..... A63B 21/4033 482/53
D795,364 S * 8/2017 Chang ..... D21/670
2009/0163325 A1 * 6/2009 Piaget ..... A63B 22/0056 482/53
2010/0087299 A1 * 4/2010 Babiarz ..... A63B 21/00069 482/142
2012/0184412 A1 * 7/2012 Glaner ..... A63B 21/05 482/30
2013/0316885 A1 * 11/2013 Harwin ..... A63B 26/003 482/142
2020/0016455 A1 * 1/2020 Van Strander ..... A63B 21/4029

* cited by examiner

*Primary Examiner* — Nyca T Nguyen
*Assistant Examiner* — Zachary T Moore

(57) ABSTRACT

An improved compact exercise machine includes a resistance system with respect to a base for allowing an exerciser to perform a wide range of exercises on a resistance system exercise machine. The compact exercise machine generally includes an exercise machine that has a resistance system with respect to a base. The exercise machine may assume one or more compact configurations to adjust the base of the exercise machine. One or more actuators may be connected to the base of the exercise machine to effectuate the resistance system of the exercise machine with respect to the base.

3 Claims, 6 Drawing Sheets

Back View

GYMPERFORMANCE EXERCISE MACHINE

BACKGROUND—PRIOR ART

Various types of exercise equipment designed to provide the user with such aerobic resistance machines have been developed and are well known in the art. For instance, one type of exercise equipment employed by individuals to aerobically exercise the body is free weights or bar bells. While this can provide the user with an excellent form of variable weight resistance and aerobic activity, free weights suffer from several disadvantages. For instance, free weights are both heavy and bulky. Moreover, to perform the different type of exercise presently recommended by physical fitness experts, the user must be able to use the weights in diverse lifting motions, many of which cannot be performed using free weights.

Additionally, the user must either have several weight amounts set up at any given time so that the user can move quickly from one exercise to another, or the user must stop each time and change the weights out for the next exercise—a stop that greatly inhibits the aerobic benefits of the workout.

To overcome these disadvantages, rack weight machines have been provided that are assembled to allow the user to easily move from one weight station to another and quickly set the weight amounts, thereby providing a machine that is capable of delivering a resistance/aerobic workout. However, these machines are also often bulky, heavy, expensive or found in expensive exercise gyms and take up a significant amount of space.

Over the years, exercise machines have undergone vast changes in an attempt to provide the user with an exercise machine that is capable of providing a compact, lightweight form of resistance and simultaneously give the user a good aerobic workout. These devices typically employ diverse forms of mechanical apparatus to achieve these goals, such as bicycling, rowing, jogging, and striding and stair climbing apparatus. For example, U.S. Pat. No. 4,645,200 to Hix; U.S. Pat. No. 4,989,858 to Young, et al.; U.S. Pat. No. 5,104,363 to Shi and U.S. Pat. No. 4,940,233 to Bull, et al.

Some of the more recently developed machines use a resistance that is created by a complex system of electronically actuated brake type devices that are controlled by microprocessors.

Although these systems can provide the user with a resistance and aerobic workout, they suffer from the disadvantage that they are susceptible to mechanical failure and regular maintenance requirements due to their complex integrated mechanical and electronic design. Another disadvantage lies within the positive displacement cylinders that are typically employed in such devices. The positive displacement cylinders generally used are conventional shock absorbing type cylinders. For example, a typical structure of such a device includes a cylinder having a piston disposed therein. The piston having a fluid port there through and attached to a rod extending externally from the cylinder that is mechanically attached to a lever arm. The cylinder has an incompressible positive displacement fluid or oil within the cylinder that is forced from one end of the cylinder to the other via the fluid port in the piston as the piston is reciprocated within the cylinder. During use, the positive displacement fluid's temperature increases due to the friction that is created from the fluid being forced back and forth through the piston's fluid port. Since the fluid is confined to a rather small volume with little surface area, the heat is not easily dissipated from the fluid. Thus, the temperature of the fluid quickly increases and since positive displacement fluids have a positive viscosity index, the heat quickly breaks down the fluid's viscosity. The resistance of the cylinder is thus decreased because the fluid moves more easily through the fluid ports in the piston and the resistance and aerobic benefits to the user are decreased as well. Moreover, the lower viscosity may also cause the fluid to leak from the seals in the cylinder.

Another disadvantage of the conventional exercise positive displacement systems is that the fluid ports cannot easily be adjusted to change the resistance of the positive displacement system. Typically, to change the resistance, the user must interrupt his exercise routine and manually adjust the mechanical advantage of the lever arm with respect to the cylinder to either increase or decrease the resistance. This interrupts the user's aerobic activity and therefore decreases the effectiveness of the exercise routine.

Additionally, a number of other disadvantages exist including:

(a) People with physical/mobility disabilities who have a need and desire for regular physical activity are limited to the accessibility and usability of high-quality exercise equipment.

(b) Costs associated with expensive exercise equipment, fees and transportation to a fitness or recreation facility are other frequently reported barriers to physical activity engagement.

(c) Time restrictions. People commonly state they are too busy to get to the gym or recreation facility.

(d) Equipment is strenuous, painful, unsightly or difficult to use.

SUMMARY

One aspect of the present embodiment may take the form of an improved exercise machine.

Advantages

Over the last two decades, emphasis has been placed on the benefits of an aerobic workout, which most importantly, offers protection from cardiovascular disease. Accordingly, several advantages of one or more aspects of the present embodiment are as follows:

The present embodiment may attach to fixed and non-fixed items that may allow the user to achieve a high-quality low-impact aerobic exercise while user is in non-traditional exercise environments.

The present embodiment may provide a relatively easy to use exercise system for those with limited mobility or wheelchair bound.

The present embodiment may interface with technology. The present embodiment may be used as a physical activity tracker. Also, the present embodiment may assume more than one shape, as the present embodiment may be capable of folding in half forming a compact configuration while having a lever or handle for easy transport.

Additionally, the present embodiment may have a lever or handle that may provide for easy transport of the present embodiment.

Furthermore, the present embodiment is lightweight and attractive.

Thus, some embodiments provide an exercise machine that is improved, and less expensive than prior art. Other advantages of one or more aspects will be apparent from a consideration of the drawings and ensuing description.

DRAWINGS—FIGURES

In the drawings, closely related figures have the same number but different alphabetic suffixes.

Figure 1:
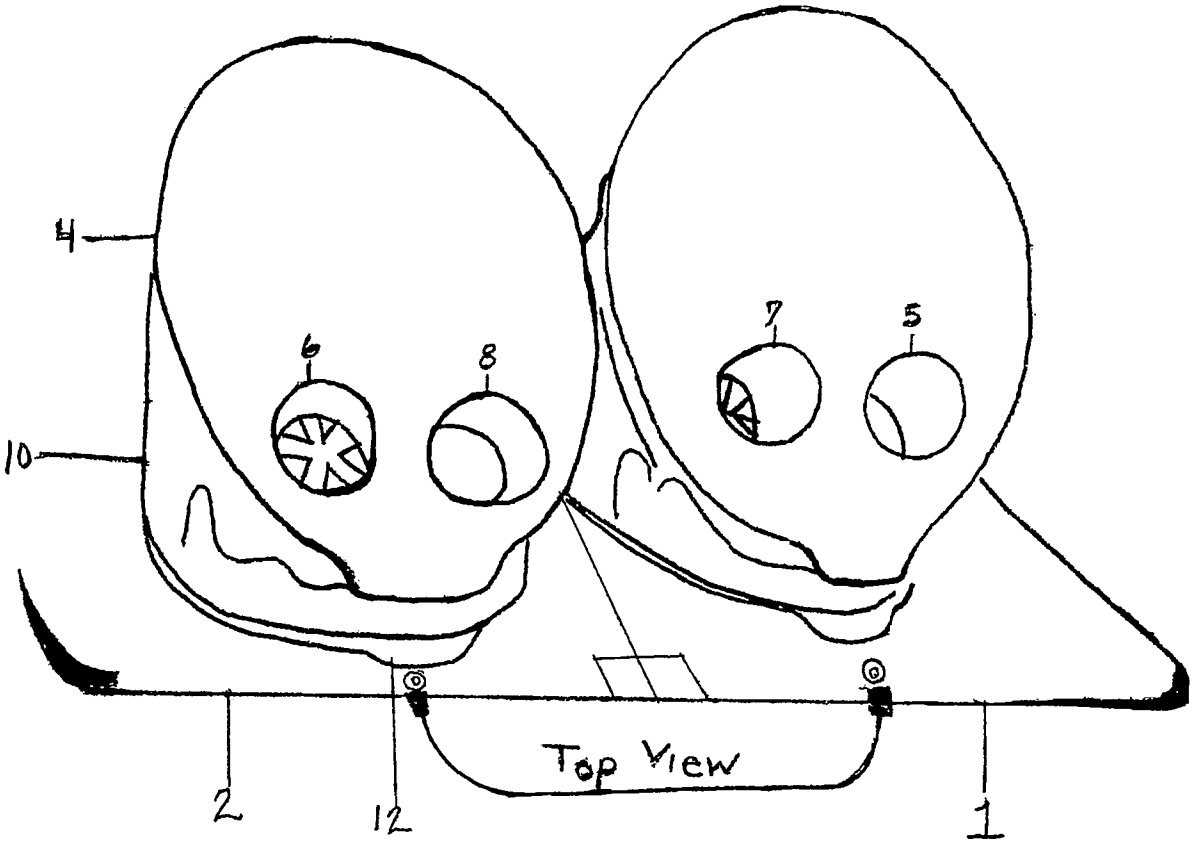
FIG. 1 shows various aspects of this exercise machine in accordance with one embodiment.

| Drawings - Reference Numerals | | |
|---|---|---|
| 2 Base | 3 Edge Trim | 4 Pump |
| 6 Air Valve | 10 Pump Cover | 12 Pump Base |
| 14 Fastener | 16 Hole | 18 Grommet |
| 20 Connecting Link | 22 Handle | 24 Hinge |

DETAILED DESCRIPTION OF THE EMBODIMENT

Figure 2:
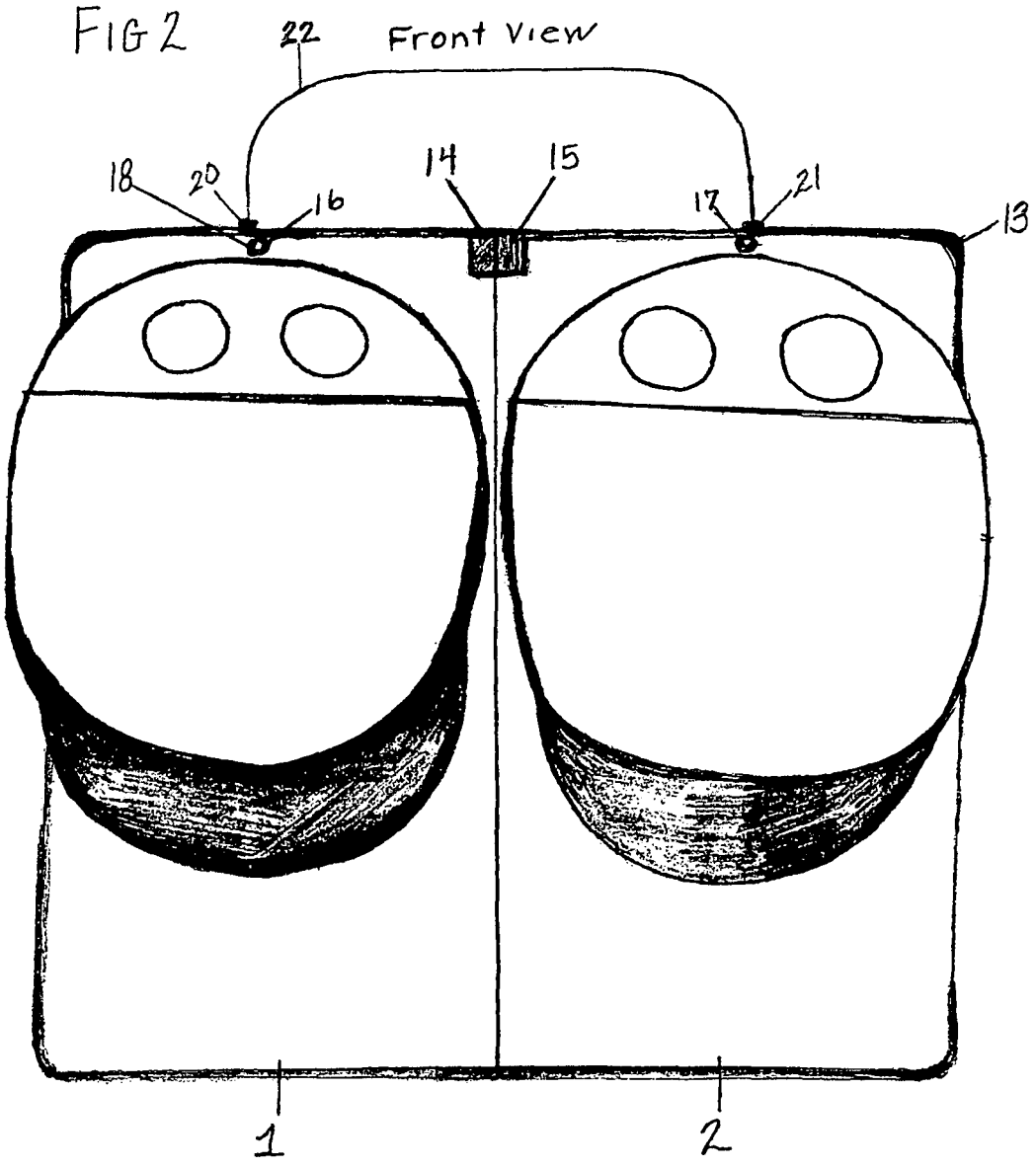
FIG. 2 shows a frontal view of the exercise machine in the position primarily but not limited to the intended purpose in accordance with another embodiment.
Figure 3:
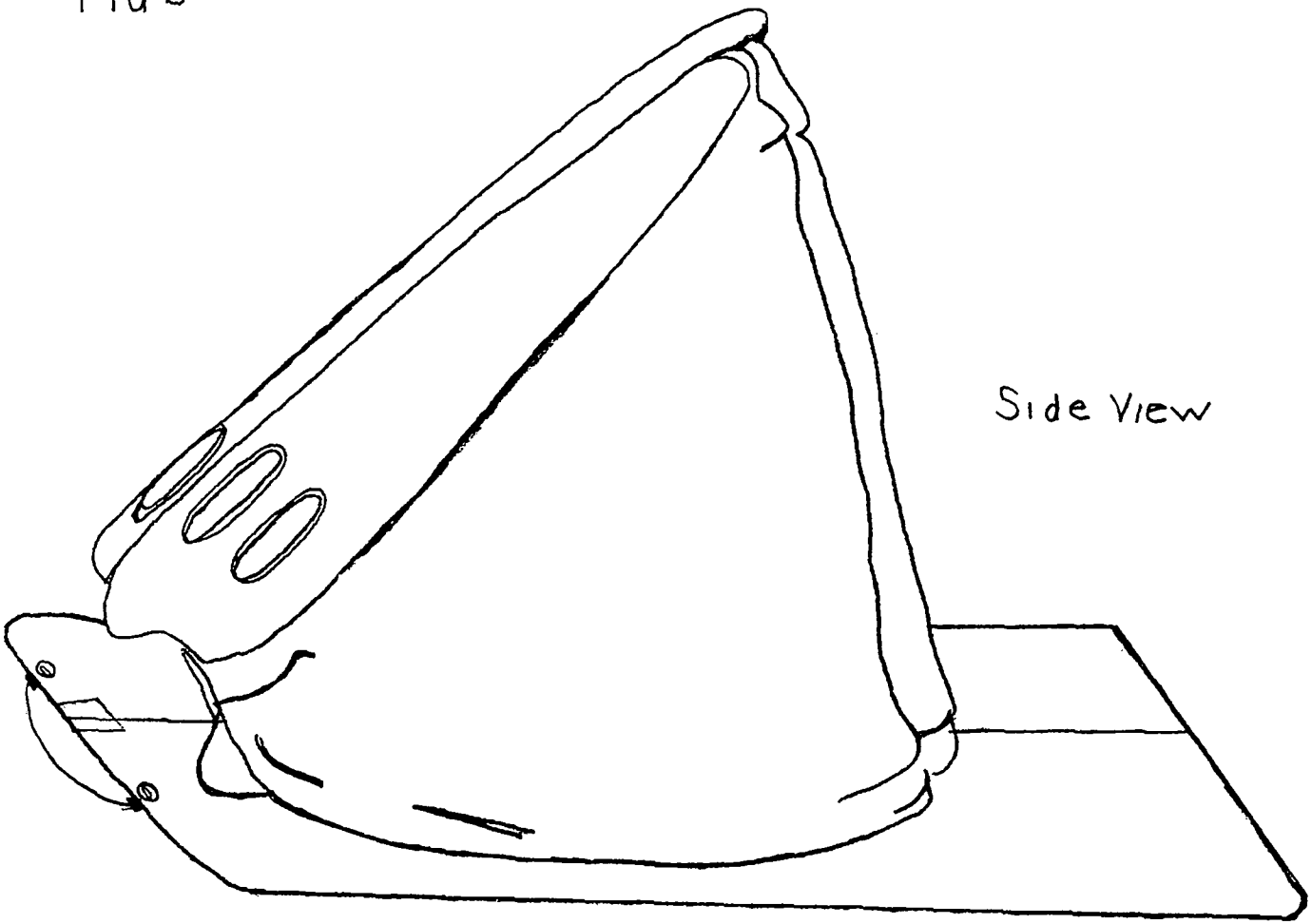
FIG. 3 shows a side view of the exercise machine on a flat surface while in the extended position in accordance with another embodiment.

The first embodiment of the fitness machine is illustrated in FIG. 2 (front view). The fitness machine has a base 1 and base 2 consisting of a rigid material that may be impact resistant. In one embodiment, the base is a rigid plastic, such as polycarbonate-available at Home Depot (nationwide), Amazon (online), TAP Plastics stores (West Coast). However, the base can consist of any other material that is rigid/impact resistant such as wood, metal, various plasticized materials, etc.

In one embodiment, the base is typically 3.175 mm in thickness and has overall dimensions roughly from 508 mm×483 mm (oblong shape, square shape, etc.). In one embodiment the outer four corners may be typically beveled or rounded to avoid snagging and personal injury.

Figure 4:
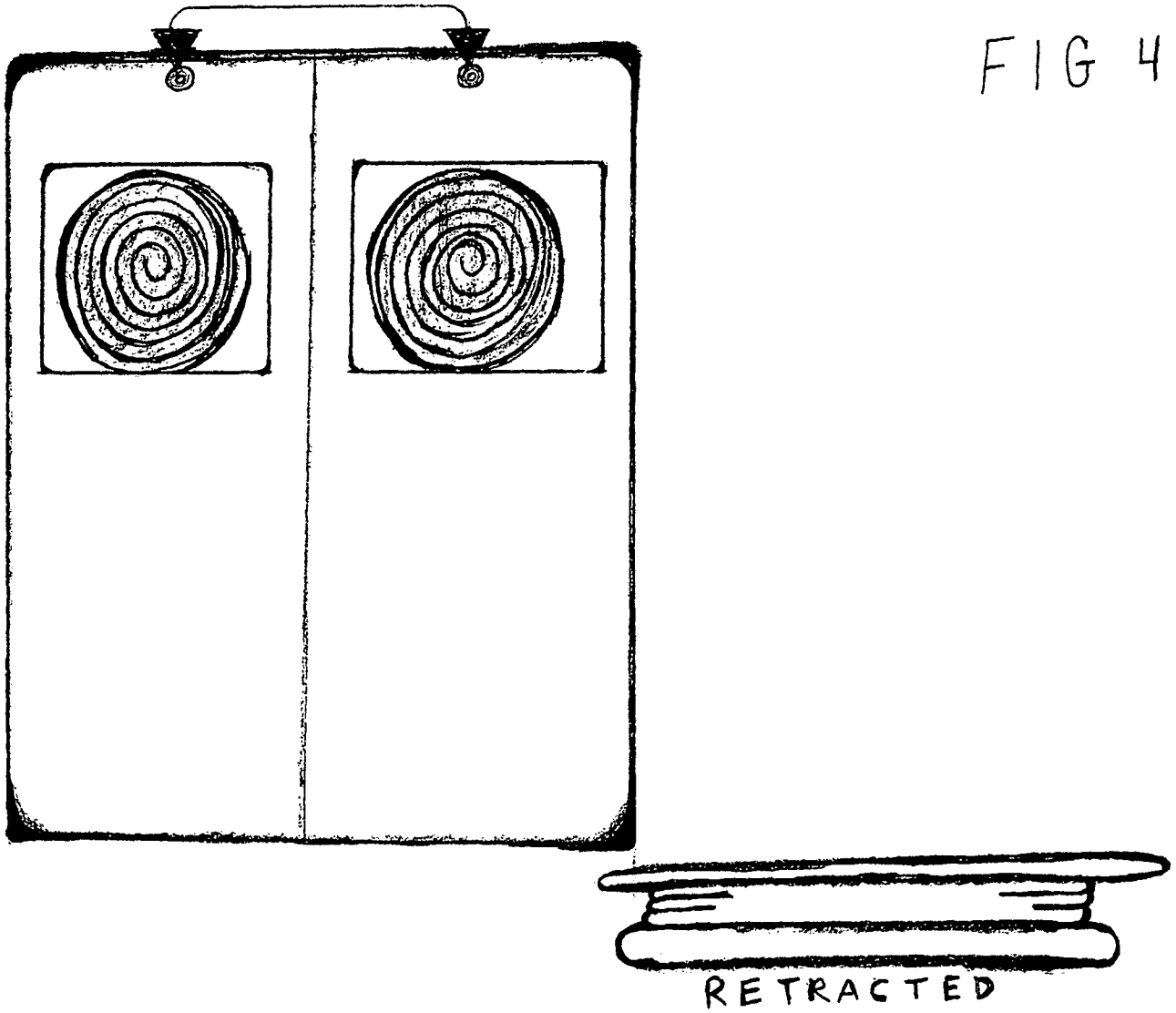
FIG. 4 shows the exercise machine in the deflated position completely retracted and devoid of air in accordance with another embodiment.
Figure 5:
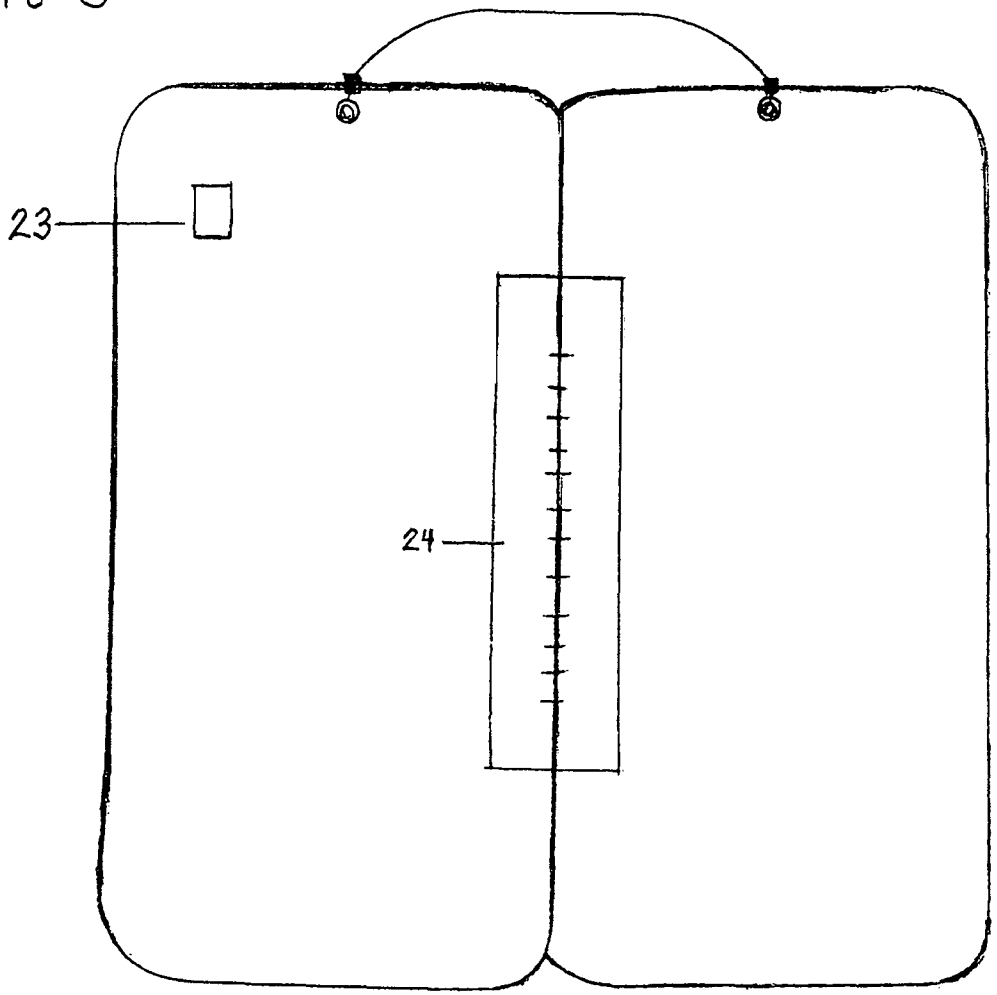
FIG. 5 shows a back view of the exercise machine in accordance with another embodiment.
Figure 6:
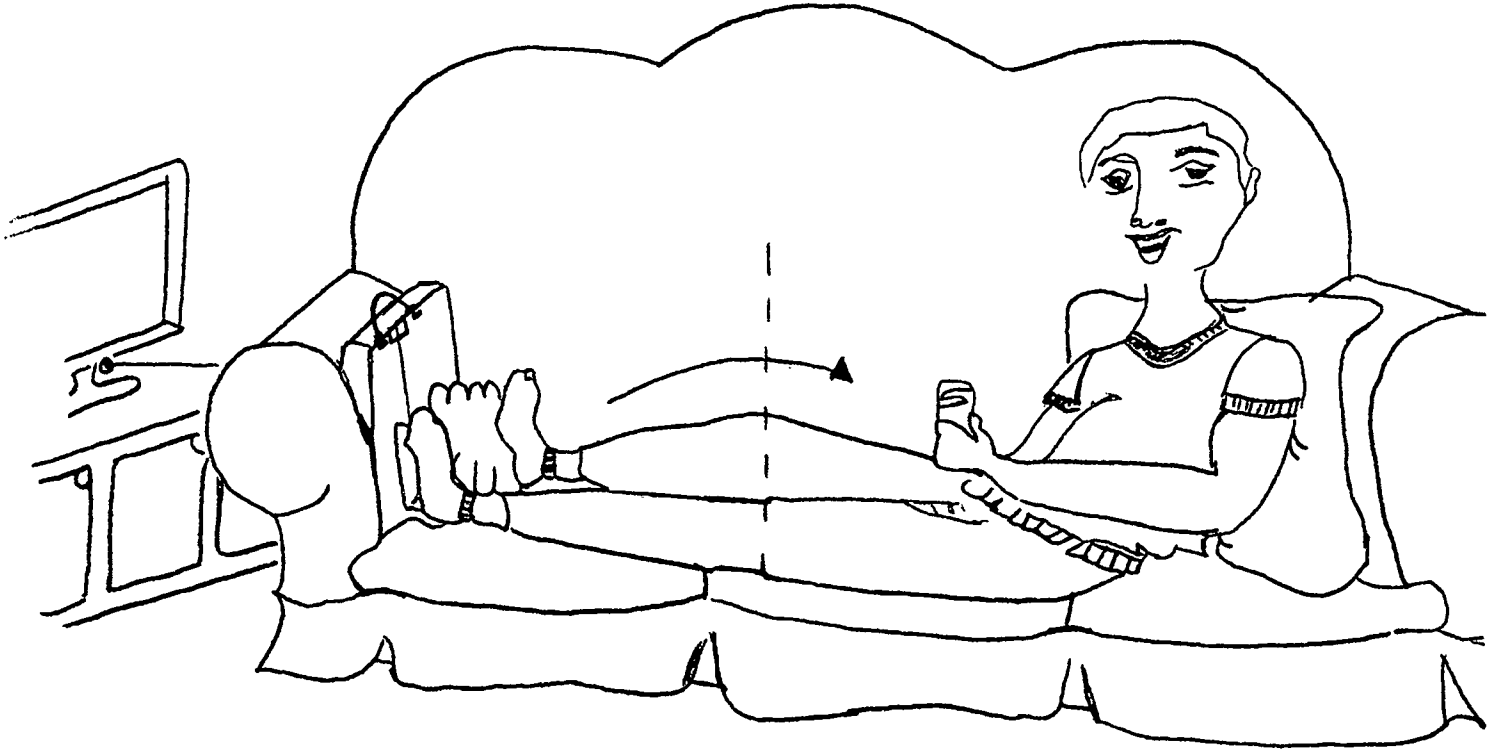
FIG. 6 shows exercise machine in use in one position but not limited to the intended purpose in accordance with one embodiment.

FIG. 4 (back view) illustrates one embodiment in which base 1 may be joined to base 2 by a hinge 24. Hinge 24 of this embodiment may be made of clear acrylic butt-join, but other materials are also suitable. Hinge 24 of this embodiment has overall dimensions roughly from 38.1 mm×304.8 mm, but in some embodiments, may be longer, up to and including 330.2 mm. Hinge 24 of this embodiment may be joined to base 1 and base 2 using TAP Acrylic Cement-available at all TAP Plastics stores (West Coast) but other materials are also suitable.

FIG. 2 (front view) illustrates one embodiment in which Cowles Custom Edge Trim 13 may be attached (Cowles Custom Edge Trim 13 installs with adhesive) to edges of base 1 and base 2 to avoid chips, scratches and protect from personal injury. However, other materials may be suitable.

FIG. 2 (front view) illustrates one embodiment in which a handle 22 may be connected to base 1 and base 2.

In this embodiment handle 22 may be made with coated wire fabricated with material that has cushioning properties thereby minimizing any pain that may be experienced in grasping the handle 22. However, other materials may be suitable including: vinyl, polyurethane, and leather.

In another embodiment the handle 22 having holding parts with both sides of holding parts forming an arc strengthening support with distal ends registering into parallel holes 16,17 (FIG. 2) at the top middle section of base 1 and base 2 to form a semi cylindrical shape for the reception of the connecting link 20 and 21 (FIG. 2). In this embodiment, parallel holes 16,17 may have overall dimensions of 9.5250 mm. However, other sizes may be suitable. FIG. 2 illustrates another embodiment in which a grommet 18 may be used to protect parallel holes 16,17 from any type of damage. In this embodiment, grommet 18 may be made with rubber having overall dimensions of 6.4 mm. However, other sizes or materials may be suitable. In this embodiment the connecting link 20,21 may be consisting of ferrules made of aluminum steel with overall dimensions of 3.175 mm. However, other materials may be suitable. In another embodiment, the handle 22, and the connecting link 20 and 21 may assume various forms and shapes but essentially has inwardly directed aligned terminals firmly and reliably secured to exercise machine.

FIG. 1 (top view) illustrates another embodiment in which pump 31 may be joined to base 1 and base 2. Pumps 41 and 32 of this embodiment are typically foot or hand pumps such as Intex Giant Bellows Foot Pump. Pump 4 and pump 3 of this embodiment has overall dimensions from 304.8 mm×215.9 mm. In this embodiment, pump 4 and pump 3 may be attached to base 1 and base 2 using E6000 an adhesive formulated to meet high performance industrial requirements. It is a non-flammable, vibration proof product that forms a permanent, waterproof bond. In this embodiment, E6000 may be applied to entire bottom of pump base 12 and pump base 13 forming a permanent, waterproof bond with base 1 and base 2. However, other bonding materials may be suitable.

In this embodiment pump 4 and pump 3 may be dual action pumps manually driven that respectively operate in tandem with each other during each pumping stroke. FIG. 1 illustrates in this embodiment, air valve(s) 5-8 which may be used to push air. However, other materials may be suitable.

FIG. 1 illustrates another embodiment in which pump 4 and pump 3 may have a surrounding surface or pump cover 10 which may be consisting of industrial nylon to protect pumps from damage. However, other materials may be suitable.

FIG. 2 illustrates one embodiment in which fasteners 14, 15, and 23 may be used to attach external objects or devices to base 1 and base 2. In this embodiment H&L fasteners, which are well known in the industry, may be used. However, other fastener materials and sizes may be suitable. In this embodiment, the overall dimensions for fasteners 14, 15 may be 2.54 mm×7.62 mm. In this embodiment, the overall dimensions for fasteners 23 may be 22.2250 mm. In this embodiment, fastener 14, and 15 may be used to fasten or attach electronic devices such as smart phones. However other devices or materials may be suitable. In this embodiment, fastener 23 may be used to attach writing instruments. However, other instruments or materials may be suitable.

Operation

The embodiments disclosed herein provide a compact exercise machine having a flexibility to attach the exercise machine to fixed, non-fixed and moveable objects. The exercise machine is easily transported with the use of the exercise machines lever or handle effectually secured to the compact exercise machine, which may be carried and utilized under the weight of the exercise machine. The exercise machine may attach to various types of furniture and the exercise machines structure and handle greatly facilitates the operation of the compact exercise machine. The new, or different compact exercise machine can be constructed to include benefits over conventional compact exercise machines, such as smoother or improved use of exercise machine while reclining or sitting. Improved performance in operation requiring less force or effort by a user can be particularly important in exercising for weakened or lessable users, such as in a medical or hospital setting, or a retirement home. Additional environments are envisioned. The new, different, or variables can otherwise have required a structure, as described herein, which may have necessitated a structure(s), and thus, an unfamiliar part, method, or movement of the exercise machine for the user.

The current disclosure improves the construction by accounting for the new or different structures while providing the user the familiar operation and exercise routines. To the extent not already described, the different features and structures of the various embodiments may be used in combination with each other as desired. That one feature may not be illustrated in all of the embodiments is not meant to be construed that it may not be, but is done for brevity of description.

CONCLUSIONS, RAMIFICATIONS, AND SCOPE

It can be appreciated that at least one embodiment of the exercise machine may also be utilized to provide a more dependable, compact, yet economical device that may be used by persons of almost any age. Various modifications to the disclosed embodiments will be readily apparent to the reader, and the general principles defined herein may be applied to other embodiments and applications without departing from the spirit and scope of the present embodiment. Many other variations are possible. For example:

Structure can be made of a different color and changed in size or shape

Resistance system can be made of different material or changed in size

Data can be stored using different materials.

Thus, the various features of the different embodiments may be mixed and matched as desired to form new embodiments, whether or not the new embodiments are expressly described. All combinations or permutations of features described herein are covered by this disclosure.

I claim:

1. A compact exercise machine allowing an exerciser to perform a wide range of exercises comprising:

an elongated first and second base wherein the first a nd second base are joined together by a hinge, wherein the first and second base each have an upper surface, wherein the first and second base are configured to be folded into a compact configuration by the hinge;

a handle selectively fixed to the first and second base;

a first and a second pump joined to the upper surface of the first and second base respectfully and configured to be manually driven by the exerciser's feet;

wherein the first and second pump each have a circular nylon covering;

wherein the first and second pump each have an upper and lower surface, wherein the upper surface of each pump is angled relative to the upper surface of the first and second base respectfully;

wherein each upper surface of the first and second pump have a plurality of air valves; and wherein the first and second base is configured to be selectively attached to furniture.

2. The compact exercise machine of claim 1, further comprising: a fastener on the opposite side of the base than the first and second pump, said fastener configured to attach writing instruments.

3. The compact exercise machine of claim 1, further comprising: a pair of fasteners on the first and second base, said pair of fasteners configured to selectively attach a smart phone.

* * * * *